US006464808B2

(12) United States Patent
Pasquinet et al.

(10) Patent No.: US 6,464,808 B2
(45) Date of Patent: Oct. 15, 2002

(54) METHOD AND APPARATUS FOR REDUCING WRINKLES ON A STRIP IN A RAPID COOLING ZONE OF A HEAT TREATMENT LINE

(75) Inventors: Catherine Pasquinet, Bonneuil sur Marne (FR); Xavier Cluzel, Paris (FR); Akli Elias, Metz Devant les Ponts (FR); Jérôme Muller, Courcelles-Chaussy (FR)

(73) Assignees: Stein Heurtey, Ris-Orangis (FR); Sollac, Puteaux (FR)

( * ) Notice: Subject to any disclaimer, the term of this patent is extended or adjusted under 35 U.S.C. 154(b) by 0 days.

(21) Appl. No.: 09/737,769

(22) Filed: Feb. 12, 2001

(65) Prior Publication Data

US 2002/0124916 A1 Sep. 12, 2002

(30) Foreign Application Priority Data

Dec. 17, 1999 (FR) ..... 99 16011

(51) Int. Cl.[7] ..... C21D 9/573

(52) U.S. Cl. ..... 148/661; 148/657; 266/251

(58) Field of Search ..... 148/657, 661; 266/251

(56) References Cited

U.S. PATENT DOCUMENTS 6,309,483 B1 * 10/2001 Wang et al. ..... 148/661

FOREIGN PATENT DOCUMENTS

JP 408013046 * 1/1996 ..... C21D/9/573

* cited by examiner

*Primary Examiner*—Deborah Yee
(74) *Attorney, Agent, or Firm*—Connolly Bove Lodge & Hutz LLP

(57) ABSTRACT

A method is disclosed for reducing the formation of wrinkles on metal strip subject to cooling in continuous heat treatment lines in which the strip passes through cooling zones through which cooling gas flows. The method includes the step of gradually modifying the cooling intensity at each change in the slope of the cooling cycle.

17 Claims, 4 Drawing Sheets

METHOD AND APPARATUS FOR REDUCING WRINKLES ON A STRIP IN A RAPID COOLING ZONE OF A HEAT TREATMENT LINE

FIELD OF THE INVENTION

The present invention relates to improvements made to the rapid cooling chambers of metal-strip heat treatment lines. Its purpose is more particularly to reduce the formation of wrinkles which form on metal strip subjected to cooling in continuous heat treatment lines, in which the said strip is made to pass through cooling zones provided with means for blowing a cooling

BACKGROUND OF THE INVENTION

In order to clearly situate the technical field to which the present invention applies, reference will firstly be made to FIG. 1 which shows, schematically, in perspective and with partial cut-away, the cooling zone of a metal strip in a heat treatment line.

This FIG. 1 shows the strip 1 passing through the rapid cooling zone 2, by passing over an entry roller 3 and an exit roller 10. During the passage through the zone 2, the strip 1 is exposed to jets of cooling gas blown by a certain number of pairs of boxes, such as 4 and 5 and 6 and 7, each box being provided with blowing means and being positioned on either side of the strip. The cooling boxes, such as 4 and 5 and 6 and 7, have a limited length so as to allow one or more rollers or pairs of stabilizing rollers, such as the rollers 8 and 9, to be fitted between two consecutive boxes, such as 4 and 6 and 5 and 7 respectively, these well-known rollers being intended to guide and stabilize the strip 1.

The cooling gas is blown onto the strip by any conventional means such as those described for instance in U.S. Pat. No. 3 068 586.

The graph illustrated by FIG. 1A, associated with FIG. 1, shows the intensity $\phi$ of the cooling undergone by the strip 1 during its passage through the zone 2. During its entry between the first cooling boxes 4 and 5, the strip is suddenly exposed to a high cooling flux, the intensity of which remains constant over the entire length of the cooling box, then this intensity increases suddenly on leaving the said boxes. This variation in the intensity of the cooling undergone by the strip is repeated when it passes between each successive pair of cooling boxes placed over the entire length of the zone 2, as may be seen clearly in FIG. 1A.

The intensity of the strip cooling over the length of a box depends on the temperature of the cooling gas blown, on the geometrical characteristics of the blowing orifices of the boxes and on the distance of the strip from these orifices.

The performance of the strip-coating or heat-treatment lines is increased by the use of rapid cooling cycles or cycles comprising a succession of relatively rapid cooling slopes which require very high cooling gas flow rates to be used.

FIG. 2 of the appended drawings illustrates such a type of cooling cycle for which, for example, the strip is cooled according to the slopes A–B, C–D and E–F, at least one of these slopes being greater than the characteristic cooling slopes of the prior art. In FIG. 2, the sections B–C and D–E correspond to the discontinuities in the cooling which are associated with the gaps between the blowing boxes in order to fit the stabilizing rollers, such as the rollers 8 and 9 shown in FIG. 1.

This increase in the cooling slopes has given rise to a critical problem in this type of cooling zone, namely the formation on the strip of wrinkles which degrade the quality of the product. The objective of the present invention is to solve this problem by providing a solution which makes it possible to limit the formation of wrinkles on the strip during rapid cooling, while at the same time preserving the nominal speed of the strip in its passage through the rapid cooling zone, that is to say without any loss of production.

The technical problem posed by the solutions according to the prior art, and which is solved by the present invention, will now be explained in detail.

DETAILED DESCRIPTION

Cooling the strip under the effects of the jets of gas blown boy the cooling boxes causes a contraction of the material of the strip in the directions parallel and perpendicular to the running direction of the strip. The contraction in the running direction of the strip is compensated for by the strip tension control device with which the cooling zone, or the line into which this cooling zone is incorporated, is provided.

The contraction taking place in the direction perpendicular to the direction in which the strip runs generates compressive forces within the material which are directed towards the axis of the strip.

Over the entire length of the blowing box, the intensity of the flux cooling the strip is constant and there is no significant difference between the compressive forces existing in one section of the strip and the section which precedes it in the running direction of this strip.

When the intensity of the cooling changes rapidly, the compressive forces in one section of the strip may be greater than those which exist in the preceding section, which undergoes less intense cooling. This difference is all the greater the larger the change in cooling slope between these two sections, as is the case, for example, at the entry or exit of a pair of cooling boxes.

Figure 2:
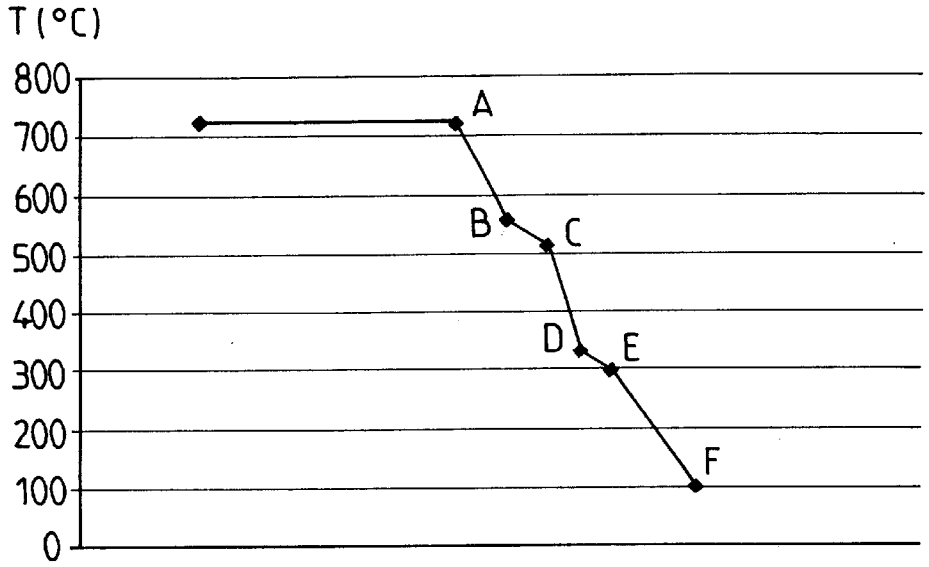
FIG. 2 illustrates a type of cooling cycle for which the strip is cooled according to slopes A–B, C–D, and E–F.
Figure 3:
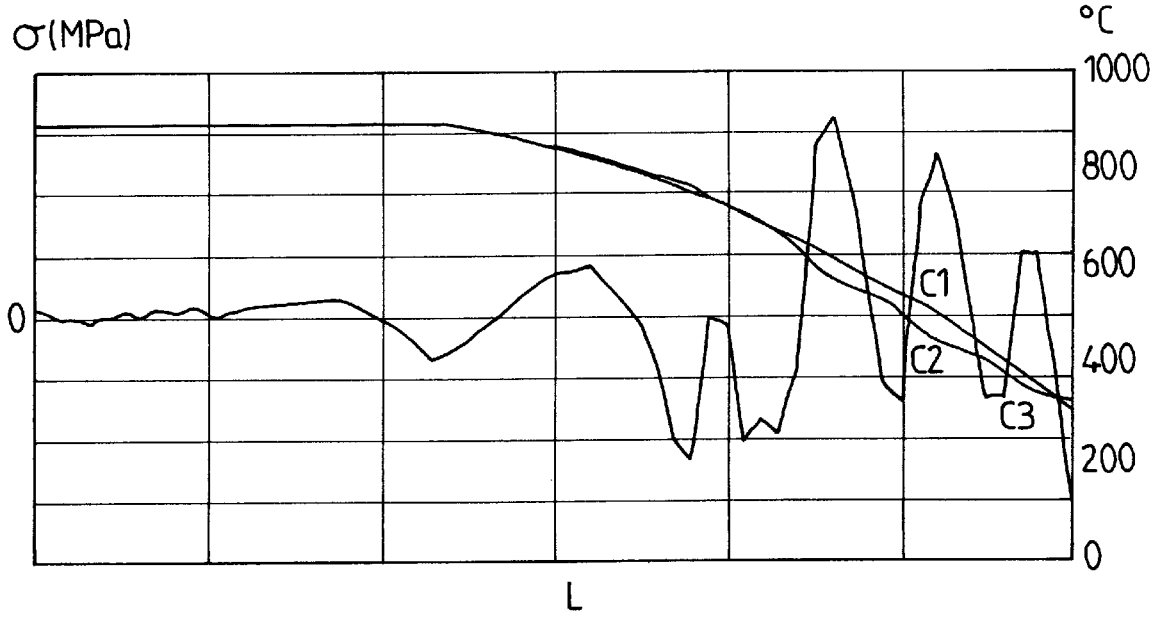
FIG. 3 illustrates the results of modelling the thermomechanical stresses which are generated in the material of the strip during various steps in the cooling of the strip.

FIG. 3 of the appended drawings shows the results of modelling, by computation, the thermomechanical stresses which are generated in the material of the strip during various steps in cooling this strip, carried out according to the cycle in FIG. 2.

This FIG. 3 illustrates the phenomenon described above and shows the variation in the temperatures over the length L of the cooling zone and the resulting stresses in the material.

Curve C1 shows the theoretical variation in the strip during its passage through the cooling zone, curve C2 shows the actual variation in this temperature with the singularities due to the discontinuity in the cooling associated with the constructional constraints on the cooling zone and curve C3 shows the variation in the stress in the material of the strip over the length of the cooling zone.

It will be noticed on curve C2 that, for each change in cooling slope, albeit a small one, there is a large stress peak in the material. As soon as the cooling slope becomes steady, the stress decreases, possibly reversing so as to reappear at the next modification in the cooling slope. It may also be seen that for each modification in the cooling slope on C2 there is a corresponding stress peak on curve C3.

Figure 1:
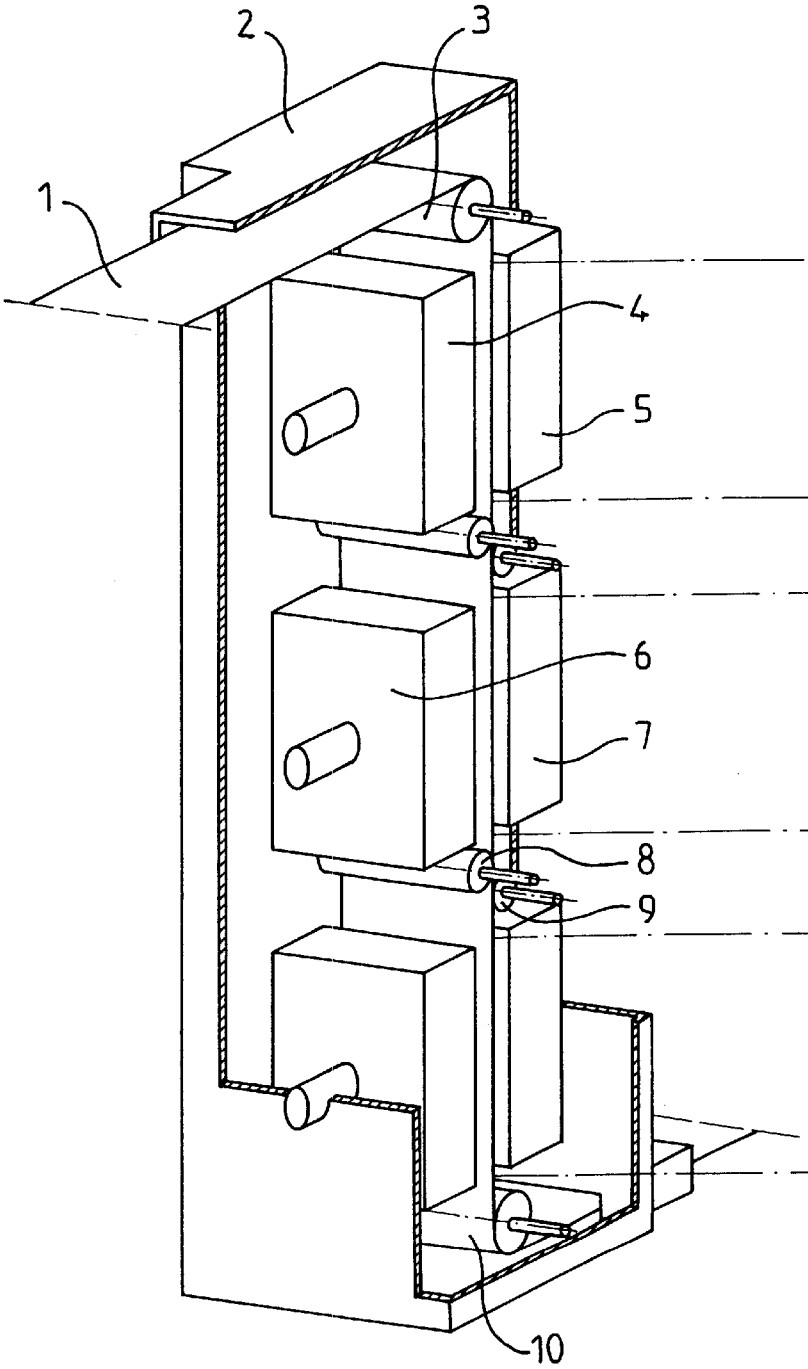
FIG. 1 shows a strip passing through a rapid cooling zone by passing over an entry roller and an exit roller.
Figure 1A:
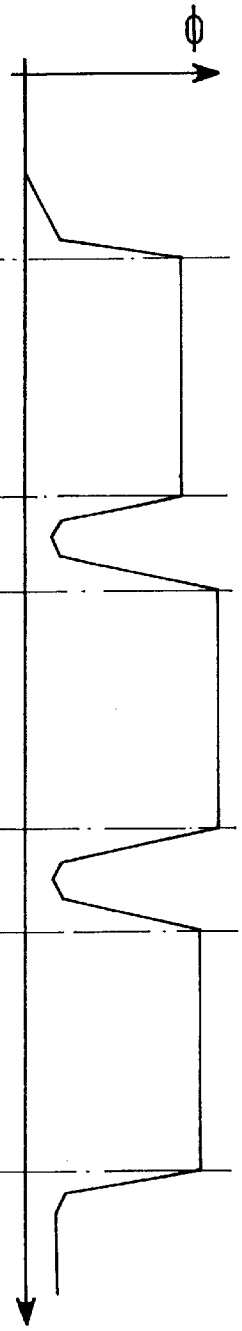
FIG. 1A is a graph showing the intensity $\Phi$ of the cooling undergone by the strip during its passage through the zone.

The magnitude of this stress peak depends on the temperature of the strip and on the change in cooling slope, that is to say on the change in cooling rate at the point on curve C2 or at the point corresponding to the moment when the strip enters or leaves the cooling zone corresponding to a pair of cooling boxes, such as 4 and 5 in FIG. 1.

The stresses perpendicular to the axis of the strip generate compressive forces whose intensity may create wrinkles in the strip. These wrinkles may take various forms; they may be continuous over the length of the strip or discontinuous, they may be parallel to the axis of the strip or may snake across its width. They may be single wrinkles or they may develop into several continuous or discontinuous parallel wrinkles which are linear or follow a regular or irregular curve.

To solve the problem resulting from the formation of these wrinkles, the present invention provides a method which is essentially characterized in that it consists in gradually modifying the cooling intensity at each change in the slope of the cooling cycle, so as to limit the corresponding stress peak in the material and to reduce or eliminate the compressive forces perpendicular to the running direction of the strip, which forces occur at that point between two consecutive sections of the strip and cause wrinkles in the latter.

Figure 4:
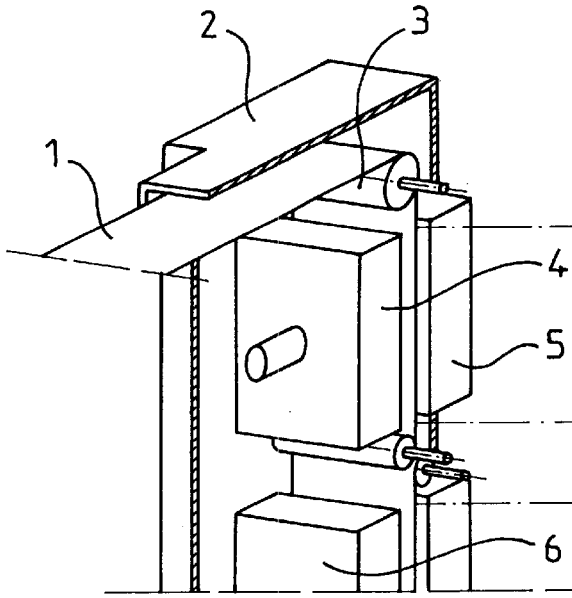
FIG. 4 shows a partial perspective view of the cooling zone shown in FIG. 1.
Figure 4A:
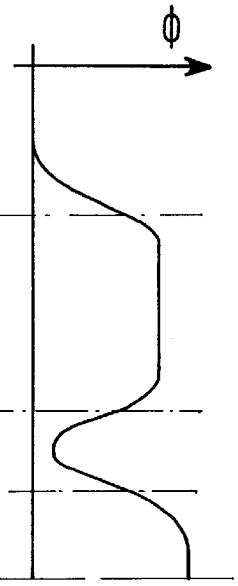
FIG. 4A is a plot similar to that of FIG. 1A but showing the effect of modifications in accordance with the invention.

The method according to the invention is illustrated in FIG. 4A, associated with FIG. 4 which shows part of a zone 2 for the rapid cooling of the strip 1, in a view similar to FIG. 1. This FIG. 4A shows the modifications to the strip cooling effectiveness which are obtained by implementing the method, at the entry and exit of the cooling boxes 4 and 5. It is obvious for a person skilled in the art that the method forming the subject of the present invention can be used at any point in the cooling zone where a change in cooling slope occurs in the strip cooling cycle.

The method forming the subject of the invention improves the quality of the end-product, given that the heat treatment carried out on the material of the strip does not make it undergo contraction liable to induce within it a stress incompatible with its mechanical properties at the temperature in question.

The method according to the invention can be implemented by any suitable means making it possible to limit the sudden changes in the cooling slope or to provide a gradual change in the cooling between the entry roller 3 and the first boxes 4 and 5, between two consecutive boxes between the exit boxes and the roller 10, or at any point in the plant where a change. in cooling slope occurs.

Various non-limiting illustrative embodiments of means for implementing the method according to the invention will be described below with reference to FIGS. 5 to 10. These figures show schematically the start of a cooling zone 2 with its first boxes 4 and 5 between which the strip 1 to be cooled is subjected to the action of the jets of cooling gas blown by the blowing means provided on the boxes.

Figure 5:
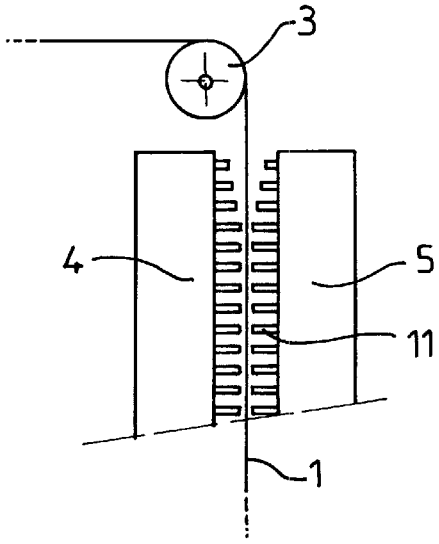
FIG. 5 shows a first embodiment of the cooling zone entry.

In the embodiment illustrated in FIG. 5, the boxes 4 and 5 are provided with conventional blowing means consisting of tubes or nozzles, such as 11, placed over the entire surface of the boxes which faces the strip 1. The boxes 4 and 5 are provided with blowing means 11 the first of which, in the running direction of the strip, have a blowing orifice/strip distance which is greater than those which are located over the central portion of the boxes so as to reduce the effectiveness of the cooling. As may be seen in FIG. 5, the distance between the blowing orifice and the strip may gradually be reduced down to the steady value over the entire length of the box so as to gradually cool the strip in accordance with the desired effect.

Figure 6:
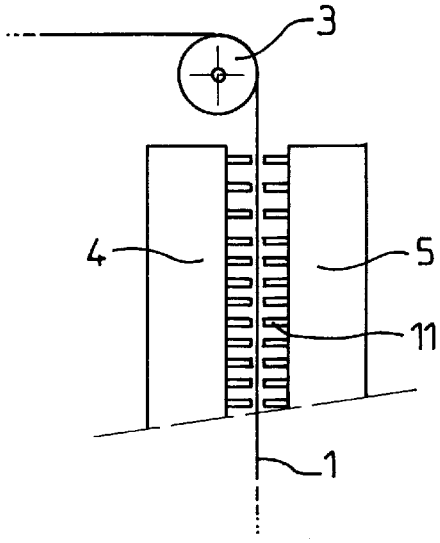
FIGS. 6 shows a second embodiment of the cooling zone entry.
Figure 7:
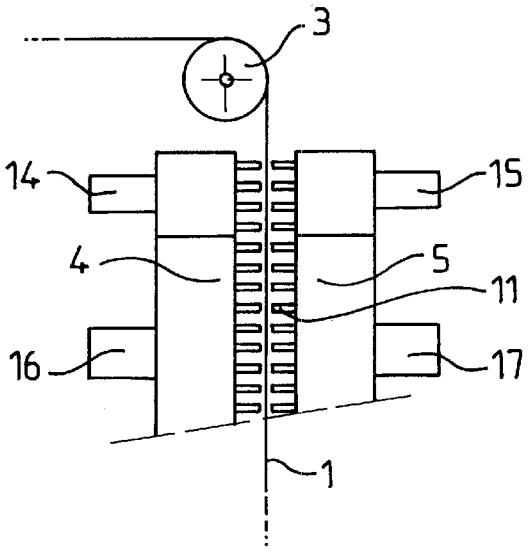
FIG. 7 shows a third embodiment of the cooling zone entry.
Figure 8:
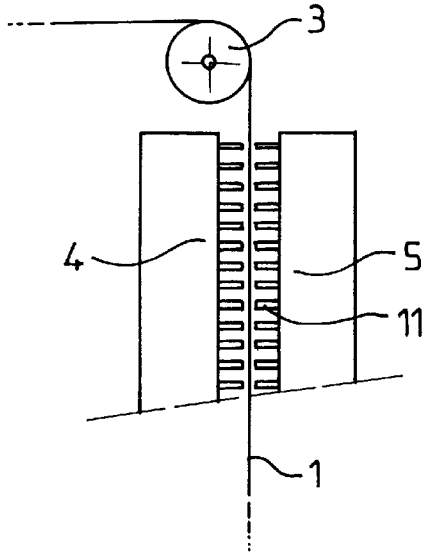
FIG. 8 shows a fourth embodiment of the cooling zone entry.

In the illustrative embodiment shown in FIG. 6, the cooling boxes 4 and 5 are provided with blowing means 11, the first of which, in the direction in which the strip advances, are arranged with a greater pitch or spacing than those located over the central portion of the boxes, so as to cool the strip gradually.

The gradual modification in the strip cooling efficiency may also be obtained by varying the supply pressure for the blowing orifices 11 of the boxes 4 and 5, for orifices located near a point at which the cooling slope changes. In the embodiment illustrated in FIG. 7, this change in the supply pressure for the blowing orifices 11 is achieved by dividing the blowing boxes 4 and 5 so that their respective entry part is supplied independently by manifolds 14 and 15 at a lower pressure than the supply pressure for the other respective parts of these boxes, which are supplied by manifolds 16 and 17.

According to the invention, the supply pressure for the various blowing regions of the same box may be modified, in a variable manner, using means external to the region, these means being controlled by the device for controlling the equipment and this being done at any point where a change in cooling intensity is produced.

A similar technical effect can be obtained by reducing the cross section of the blowing orifices 11 over that part of the boxes where it is desired to modify the cooling gradually. Such a solution is 5 illustrated in FIG. 8 in which it may be seen that, for a constant pitch or spacing, the reduction in the cross section of the blowing orifices 11 is gradual in the running direction of the strip, until these blowing orifices attain the nominal value of the overall box.

Figure 9:
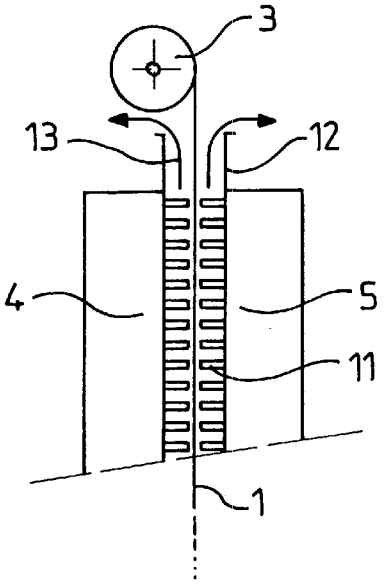
FIG. 9 shows a fifth embodiment of the cooling zone entry.

FIG. 9 shows another illustrative embodiment of the invention. In this embodiment, baffles are provided, such as the baffles 12, which are fitted on each side of the strip and on the lateral faces of the boxes 4 and 5, near the point where the change in cooling slope occurs. These baffles 12 force the cooling gas emanating from the blowing orifices 11 to flow parallel to the strip (arrow 13) in the opposite direction to the movement of the strip. The cooling gas is thus channelled between the baffles and the strip. By virtue of this arrangement, the temperature of the cooling gas rises, thus producing the desired gradual modification in cooling over the length of the baffles 12.

Figure 10:
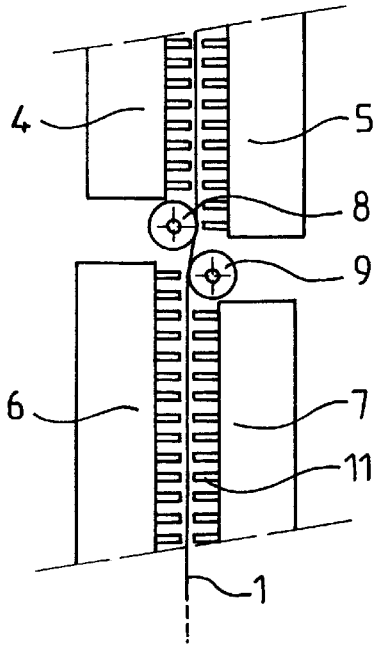
FIG. 10 shows a sixth shows embodiment of the cooling zone entry.

FIG. 10 also shows another embodiment of the apparatus according to the invention, intended to limit the break in cooling between two pairs of consecutive boxes 4, 5 and 6, 7 between which boxes stabilizing rollers 8 and 9 are positioned. In this embodiment, the blowing orifices 11 are placed on the boxes 5 and 6 over the greatest possible distance so as to limit the length of strip not subjected to the cooling. By virtue of this arrangement, the desired gradual modification in cooling is obtained.

Experiments using the invention on industrial plants have shown that the action of the various means described above can be supplemented by introducing a difference in tension between the edges and the centre of the strip. This difference in tension may be obtained by thermal or mechanical means, for example by a suitable profile of the entry roller and the exit roller 10. This difference in tension deforms the strip and its flatness, thus making it possible to limit the effects of the compressive forces which occur when there is a change in the cooling slope.

It will be understood that the means which, according to the invention, allow the strip cooling intensity to be gradually modified at each change in the cooling slope may be fitted on each region of the boxes where this change in slope occurs so as to obtain the gradual modification in cooling, at the entry or exit of the box, or at any intermediate point in this box.

Each of the means described above may be used separately or in a combination thereof.

Of course, it remains the case that the invention is not limited to the embodiments described and/or illustrated, rather it encompasses all the variants thereof. Thus, the present invention encompasses any apparatus making it possible to gradually modify the cooling of the strip at any point where its cooling slope changes.

What is claimed is:

1. Method for reducing the formation of wrinkles on metal strip subjected to cooling in continuous heat treatment lines in which the said strip passes through cooling zones having boxes provided with means for blowing a cooling gas, comprising the step of gradually modifying the cooling intensity at each change in the slope of the cooling cycle.

2. Method according to claim 1, wherein the gradual modification in the cooling intensity is obtained by adjusting the cooling power at the junction between two consecutive cooling boxes.

3. Method according to claim 1, wherein the gradual modification in the cooling intensity is obtained by adjusting the cooling power between the entry roller of the cooling zone and the first cooling box of the latter.

4. Method according to claim 1, wherein the gradual modification in the cooling intensity is obtained by adjusting the cooling power between the last cooling box and the exit roller of the cooling zone.

5. Method according to claim 1, wherein the cooling intensity is gradually modified between two or more blowing regions of the same box by varying the pressure at which the cooling gas is supplied.

6. Apparatus for cooling running metal strip, comprising:

a cooling zone through which the strip passes including an entry roller and an exit roller, the said strip being exposed to;

jets of cooling gas blown through a plurality of pairs of boxes provided with blowing orifices, each box of a pair lying on a respective side of the strip;

means for producing a gradual cooling of the strip at each change in the slope of a cooling cycle, the latter means being provided at the junction between two pairs of successive cooling boxes, between the entry roller and a first pair of cooling boxes, and between a last pair of boxes and the exit roller.

7. Apparatus according to claim 6, wherein the gradual cooling means modify the cooling gas supply pressure for different regions of a box.

8. Apparatus according to claim 6, wherein a distance separating the strip from the blowing orifices of the boxes varies.

9. Apparatus according to claim 8, wherein said distance variation is gradual.

10. Apparatus according to claim 6, wherein a distance between confronting blowing orifices of the boxes varies.

11. Apparatus according to claim 10, wherein said distance variation is gradual.

12. Apparatus according to claim 6, wherein the spacing between adjacent blowing orifices of a box varies.

13. Apparatus according to claim 12, wherein said spacing variation is gradual.

14. Apparatus according to claim 6, wherein dimensions of the blowing orifices of the various regions of the same box are adjusted so as to adjust the cooling power between the regions.

15. Apparatus according to claim 6, further including baffle means located near a point where the change in cooling slope occurs, for channeling the cooling gas between the baffle means and the strip in order to gradually warm the gas and reduce the cooling effectiveness over the length of the baffle means.

16. Apparatus according to claim 6, further including means for creating a difference in tension between the edges and the center of the strip, deforming the strip and its flatness and thus limiting the effects of compressive forces which occur when there is a change in the cooling slope.

17. Apparatus according to claim 16, wherein said means for creating a tension difference are provided by a profile of the entry roller and the exit roller.

* * * * *